US005513713A

United States Patent [19]

Groves

[11] Patent Number: 5,513,713

[45] Date of Patent: May 7, 1996

[54] STEERABLE DRILLHEAD

[75] Inventor: Frank K. Groves, Solvang, Calif.

[73] Assignee: The United States of America as represented by the Secretary of the Navy, Washington, D.C.

[21] Appl. No.: 188,612

[22] Filed: Jan. 25, 1994

[51] Int. Cl.[6] ..... E21B 7/08

[52] U.S. Cl. ..... 175/73; 175/61

[58] Field of Search ..... 175/73, 61, 231, 175/324, 67

[56] References Cited

U.S. PATENT DOCUMENTS

| | | | |
|---|---|---|---|
| 4,211,292 | 7/1980 | Evans | 175/61 |
| 4,431,069 | 2/1984 | Dicksnson, III | 175/61 |
| 4,497,381 | 2/1985 | Dickinson, III | 175/61 |
| 4,501,337 | 2/1985 | Dickinson, III et al. | 175/171 |
| 4,524,324 | 6/1985 | Dickinson, III | 324/323 |
| 4,527,639 | 7/1985 | Dickinson, III | 175/61 |
| 4,560,934 | 12/1985 | Dickinson, III | 324/323 |
| 4,637,479 | 1/1987 | Leising | 175/26 |
| 4,655,299 | 4/1987 | Schoeffler | 175/38 |
| 4,714,118 | 12/1987 | Baker et al. | 175/26 |
| 4,790,394 | 12/1988 | Dickinson, III et al. | 175/61 |
| 4,821,815 | 4/1989 | Baker et al. | 175/26 |
| 4,836,301 | 6/1989 | Van Dongen et al. | 175/61 |
| 4,856,600 | 8/1989 | Baker et al. | 175/26 |
| 4,905,773 | 3/1990 | Kinnan | 175/19 |
| 4,930,586 | 6/1990 | Turin et al. | 175/25 |
| 4,991,667 | 2/1991 | Wilkes, Jr. et al. | 175/61 |
| 5,148,880 | 9/1992 | Lee et al. | 175/393 |
| 5,156,222 | 10/1992 | Jurgens et al. | 175/26 |
| 5,314,030 | 5/1994 | Peterson et al. | 175/26 |

*Primary Examiner*—Hoang C. Dang
*Attorney, Agent, or Firm*—David S. Kalmbaugh; Melvin J. Sliwka

[57] ABSTRACT

An apparatus for boring a continuous underground tunnel and located inside of the forward end of a continuously rotating, pushed drillstring includes a housing for receiving pressurized drilling fluid, a nozzle including bores, attached forwardly to the housing for discharging the pressurized drilling fluid from the nozzle, a rotatable valve located in said housing for receiving and forwardly directing pressurized drilling fluid from the housing to the nozzle. The valve may be rotated in a 1st position, thereby directing the pressurized drilling fluid to a first set of bores in the nozzle for boring straight ahead. The valve may also be rotated in a 2nd position, thereby directing the pressurized drilling fluid to a second set of bores. By maintaining the valve in the 1st position for ¼ rotation of each revolution of the drillstring and then maintaining the valve in the 2nd position for the remaining ¾ rotation of each revolution of the drillstring, an off axis (curved) tunnel may be bored.

7 Claims, 12 Drawing Sheets

DRILLING QUADRANTS

| NOZZLE NUMBER | MEDIUM CONFIGURATION 1 ANGLE$_1$ | NARROW CONFIGURATION 2 ANGLE$_2$ | WIDE CONFIGURATION 3 ANGLE$_3$ |
|---|---|---|---|
| 86e/f * | -20° | -15° | -20 |
| 82e/f * | 10° | 8° | 13 |
| 88e/f + | 18° | 14° | 22 |
| 84e/f + | 27° | 23° | 33 |

* READ IN CONJUNCTION WITH FIG. 11a.
+ READ IN CONJUNCTION WITH FIG. 11b.

*Fig. 12.*

| TYPE OF OPERATION gpm; psi BACK PRESSUER | ORIFICE DIAMETER (IN) | | | |
|---|---|---|---|---|
| | 86f | 82f | 88f | 84f |
| 150 gpm; 1500psi BACK PRESSUER | 0.086 | 0.141 | 0.171 | 0.171 |
| 150 gpm; 3000psi | 0.088 | 0.145 | 0.176 | 0.176 |
| 200gpm; 1500psi | 0.048 | 0.078 | 0.140 | 0.140 |
| 200gpm; 3000psi | 0.049 | 0.080 | 0.144 | 0.144 |

*Fig. 12a.*

STEERABLE DRILLHEAD

BACKGROUND OF THE INVENTION

This invention relates to underground boring devices they may be steered along a chosen path while boring. More specifically, but without limitation, the present invention relates to continuously rotating, steerable, waterjet drillheads located in the forwardly facing end of a hollow, pushed drillstring. The drillhead receives high pressure water from within the drill string and selectively directs, through the appropriate, forwardly facing nozzles, high pressure cutting jets of drilling fluid to cut a curved tunnel that the pushed drillstring will follow. In this way the waterjet drillhead may be continuously steered along a desired path. When installing inground cable, conduit or pipe such as power cables, telephone lines, fiber optic cable, gas lines, water lines or the like the method of trenching is commonly employed. However, when traversing urban areas containing streets, driveways, utilities, buildings and other "obstacles", continuous trenching is sometimes impossible. For military use, it is also desirable to traverse long distances without trenching; for example, when laying a fiber optic cable or pipeline under a beach. It is therefore, highly desirable to have the capability of providing a continuous, underground tunnel for installing cable, conduit, pipe or the like at distances of up to 25,000 feet or more. It is also desirable to steer the apparatus that can provide such an underground tunnel.

It is therefore desirable to provide a horizontal drilling system (HDS) that can reach out to very long distances of up to 25,000 feet and more in favorable conditions. However, when drilling at horizontal distances of up to 25,000 feet and more, frictional forces and push forces become very large and result in failure by buckling and/or joint failure of the drillstring. The long drilling distances also require steerability of the drillstring to accomplish both reasonable accuracy and to navigate down and under an obstacle and then up again, for example. To provide such a system, it is necessary to minimize the friction resulting from the drillstring and drillhead. Accordingly, a hollow, continuously rotating drillstring (to reduce torsion and push forces) with constant inside diameter (for pigging capability) and constant outside diameter (for reducing friction between the drillstring and the bored tunnel) is preferred. Water jet cutting (to minimize push forces and add tension to overcome buckling) and using the drillstring as a conduit for supplying pressurized drilling fluid are also preferred.

Previous systems for steering (deviating) a drillstring are inadequate to operate under these parameters and are themeselves unable to accomplish these objectives.

One jetting technique for deviating a well from vertical includes orientating a large jet at the downhole end and towards the desired direction of deviation, initiating pumping to erode the hole in that direction, applying a high bit weight and then reciprocating the drillstring. After making a few feet, the hole is conventionaly drilled for about 20 feet and the procedure is repeated until the desired angle is obtained. This method, however, requires the drillstring to be completely non-rotating during the procedure. Other well known methods for deviating a well include a bent sub with a downhole mud motor; employing a whipstick; and using a rebal tool.

U.S. Pat. No. 4,930,586 to Turin et al, dated Jun. 5, 1990 discloses a fluid jet method and apparatus that uses poppet valves to control the discharge of a portion of the drilling fluid in radical directions forming steering jets.

U.S. Pat. Nos. 4,714,118; 4,821,815 and 4,856,600 to Baker et al discloses a fluid jet apparatus and technique that utilize a forward facing, off-axis high pressure rotating jet that is pushed through the soil. The boring device is steered by modulating the rotational speed of the off axis jet and/or by modulating the direction of rotation to cause the boring device to deviate.

Still another device in U.S. Pat. No. 5,148,880 to Lee et al, discloses a downhole tool with a fluid discharge nozzle parallel to the centerline axis of the tool and a blade for directing the fluid exiting the nozzle to an acute angle relative to the drillstring thereby cutting an elongate bore.

However, all these devices are inadequate for drilling long, horizontal bores of distance of up to 25,000 feet and more. Some require the drillstring to be stopped to orientate a cutting jet in the desired direction of deviation. Others require the drillstring to be removed from the hole to install a device to physically force the drillhead in a given direction. Some only permit one deviation, for example, from vertical to horizontal.

It is therefore an object of the present invention to provide an apparatus for boring a continuous underground tunnel either straight ahead (on axis) or deviating to the side (off axis).

It is another object of the present invention to provide and apparatus for boring a continuous underground tunnel that may be used with a hollow, continuously rotating, pushed drillstring.

It is a further object of the present invention to provide an apparatus to drill a continuous underground tunnel by means of high pressure fluid jets.

It is another object of the present invention to provide an apparatus for boring a continuous underground tunnel to distance out to 25,000 feet and more.

SUMMARY OF THE INVENTION

Accordingly, the steerable drillhead of the present invention is located inside of the forward end of a continuously rotating, pushed drillstring. The steerable drillhead includes a radially ported, generally elongate housing with a forwardly attached discharge nozzle and a rearwardly protruding driveshaft; a rotatable valve located in the housing and attached to the driveshaft; an insert that supports the driveshaft and piston and seals against rearwardly flowing drilling fluid; a baseplate located between the valve and the nozzle; and a seal located around the nozzle.

In operation, the rotatable valve receives pressurized water from the radial ports in the housing, directs the water forwardly through internal bores in the valve, to either a first set of bores when the valve is rotated in one direction or to a second set of bores when the valve is rotated in the other direction. Flow through the first set of bores causes a forwardly discharge from the nozzle approximately equal to the diameter of the drillstring that cuts a concentric tunnel and permits the pushed drillstring to travel straight ahead. Flow through the second set of bores causes a forwardly discharge from the nozzle larger than the diameter of the drillstring. By turning the second set of bores "on" only during, for example, the same ¼ rotation of each revolution and by turning the first set of bores "on" only during the remaining ¾ rotation of each revolution, the forwardly discharge from the nozzle cuts a non-concentric, oblong tunnel that permits the pushed drillstring to travel in a deviated direction. By selecting a different ¼ rotation (quadrant) of each revolution, a non-concentric, oblong tunnel may be cut in any one of 4 quadrants; up, down, to the right or to the left. The steerable drillhead is attached forwardly of a mount, gearbox, motor, electronics and batteries.

BRIEF DESCRIPTION OF THE DRAWINGS

Other objects, features and advantages of the present invention will become more fully apparent from the following detailed description of the preferred embodiment, the appended claims and the accompanying drawings in which:

FIG. 12 is a table showing the angles of bores in nozzle 32 for three configurations of nozzle 32.

FIG. 12*a* is a table showing the diameters of bores in nozzle 32 for three configurations of nozzle 32 at different flow rates and back pressures.

DETAILED DESCRIPTION OF THE PREFERRED EMBODIMENT

Figure 1:
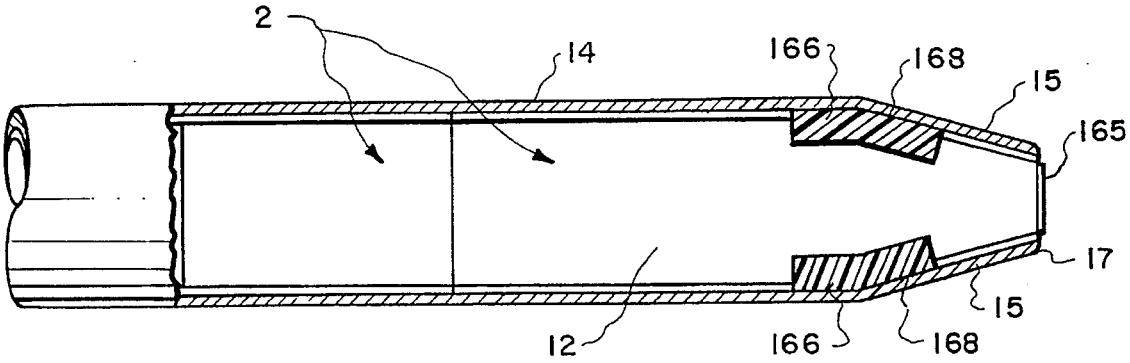
FIG. 1 is a drawing showing the steerable drillhead (SDH) assembly 2 located in drillstring 14.
Figure 1A:
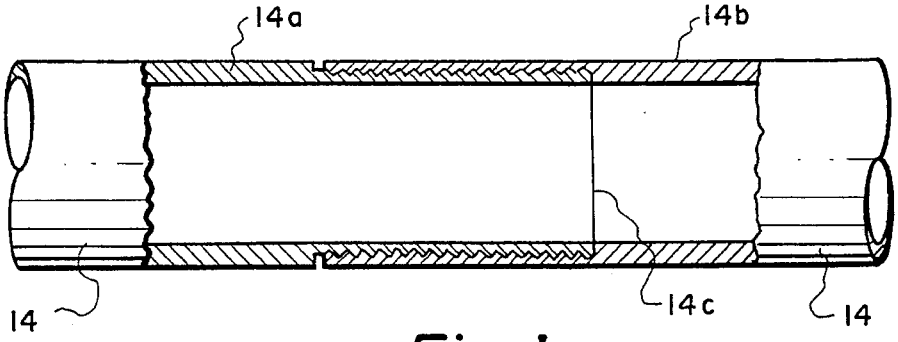
FIG. 1*a* is a cross-section of a typical joint of drillstring 14.
Figure 1B:
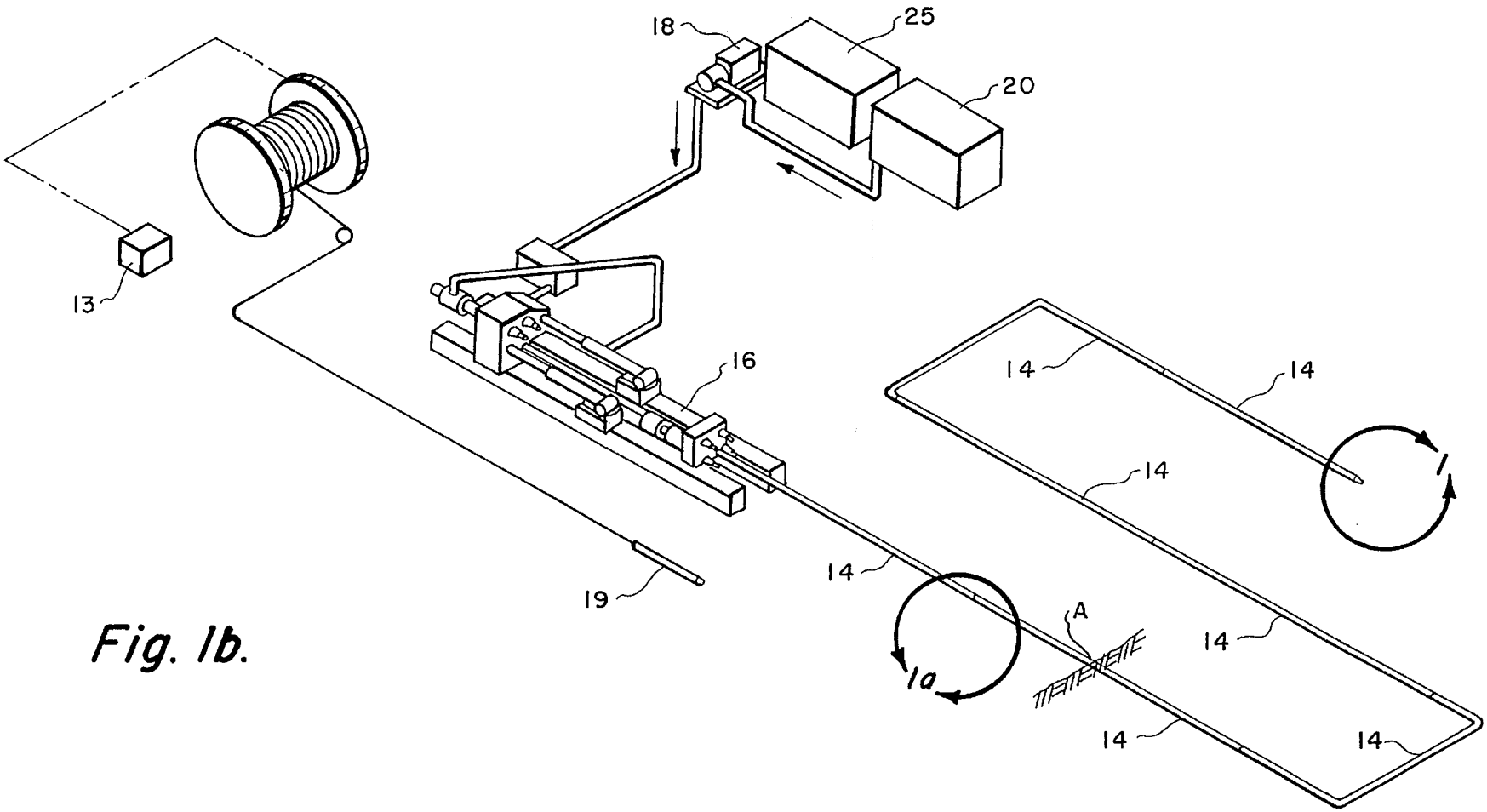
FIG. 1*b* is a drawing showing steerable drillhead assembly 2 along with the major ancillary equipment found in a drilling operation.

The steerable drillhead (SDH) assembly 2 of the present invention is illustrated by way of example in FIGS. 1–14. As shown in FIGS. 1, 1*a* and 1*b*, SDH assembly 2 is shown inside rotating drillstring 14 and providing a continuous underground tunnel between a first entry point "A" and second spaced apart exit point (not shown). Drillstring 14 is made up of a plurality of segments, usually 20 feet long, screwably joined to form a continuous length of up to 25,000 feet or more. Each segment has a threaded male end 14*a* and a threaded female end 14*b* screwably joined and forming a substantially constant inside and outside diameter. The constant outside diameter reduces friction between rotating drillstring 14 and the bored tunnel and the constant inside diameter allows the SDH assembly 2 to be inserted into and propelled through drillstring 14 by the use of pressurized drilling fluid, such as water. In the preferred embodiment drillstring 14 is made from 4145 steel alloy and is 4.75 inches O.D. and 3.5 inches I.D.

When SDH assembly 2 is installed in drillstring 14, SDH assembly 2 is both retained and sealed in drillstring 14, as shown in FIG. 1, by reduced diameter section 15 of drillstring 14. In this position, nose 165 is approximately flush with end 17 of drillstring 14.

FIG. 1*b* shows the system configuration for a typical drilling operation using, for example, the SDH assembly 2 of the present invention. In the preferred embodiment, hydraulic launcher 16 provides rotation of drillstring 14 in a speed range from 0–10 rpm; a maximum torque of 55,000 ft-lbs; and push/pull forces of 280/320 kips, respectively. Pump 18, driven by motor 25, receives water from reservoir 20 and is capable of delivering up to 15,000 psi, at a flow rate up to 200 gpm through drillstring 14 to SDH assembly 2.

SDH assembly 2 provides steering control to drillstring 14 and is a self-contained, battery-operated device that selectively directs high pressure water through a series of orifices and into the area immediately ahead of drillstring 14. The selectively directed high pressure water breaks up the material in the desired direction of travel and pushed drillstring 14 "follows" the bored path. In this way, SDH assembly 2 can be programmed to drill straight ahead or in the direction of any one of the four quadrants shown in FIG. 2. It is to be understood that in the preferred embodiment 4 quadrants were chosen as possible directions to deviate drillstring 14, however the scope of the invention should not be limited to only those possible directions, since virtually any combination of off-axis paths can be drilled.

Figure 3:
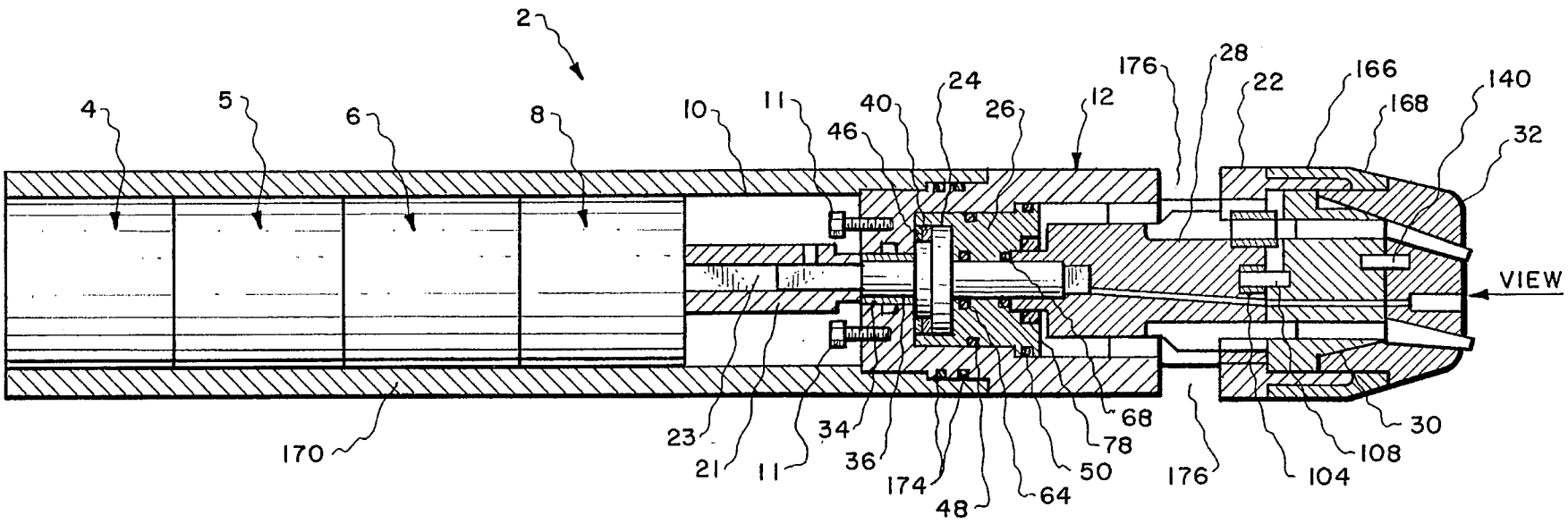
FIG. 3 is a side view, partly in cross-section, of SDH assembly 2.
Figure 4:
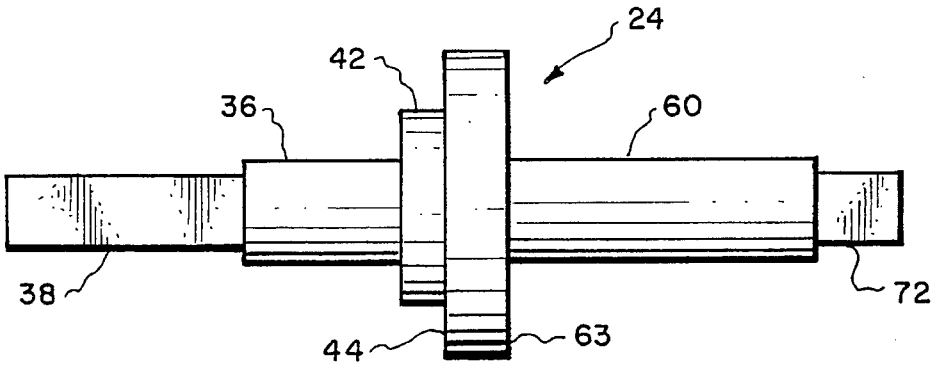
FIG. 4 is a side view of driveshaft 24.
Figure 4A:
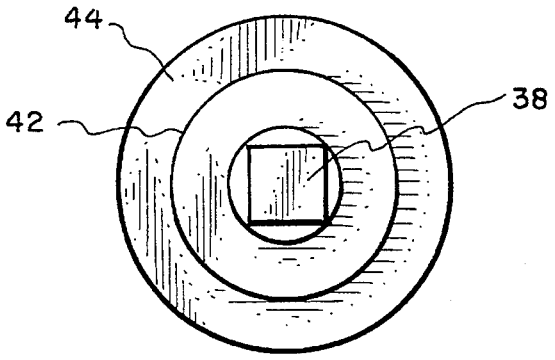
FIG. 4*a* is an end view of driveshaft 24.
Figure 4B:
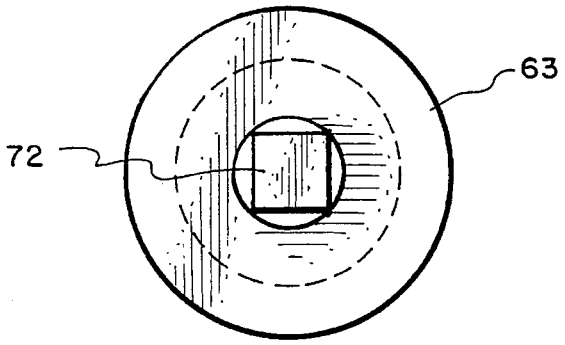
FIG. 4*b* is an end view of driveshaft 24.
Figure 5:
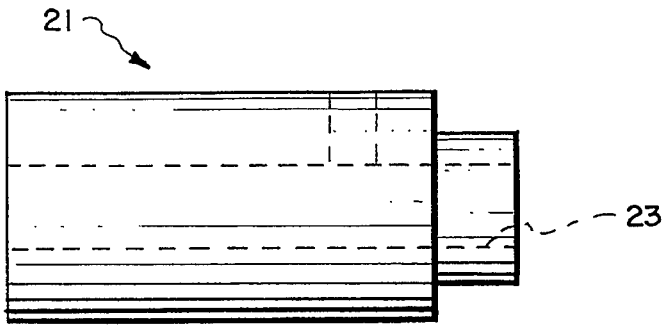
FIG. 5 is a side view of coupler 21.
Figure 5A:
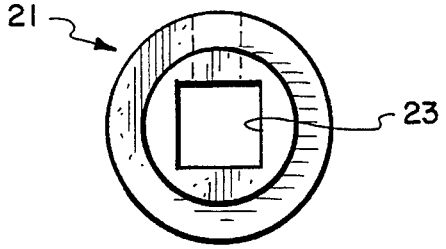
FIG. 5*a* is an end view of coupler 21.
Figure 6:
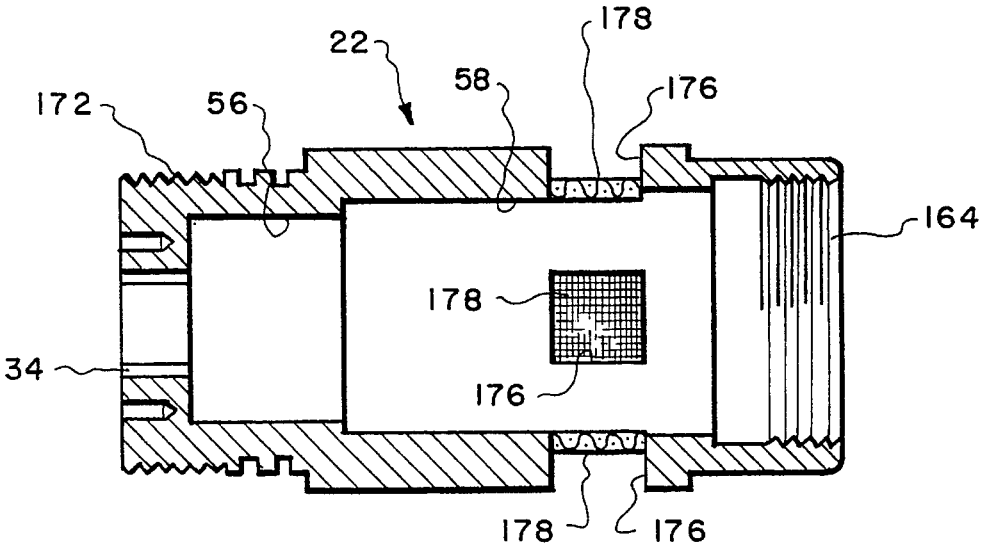
FIG. 6 is a side view in cross-section of housing 22.
Figure 7:
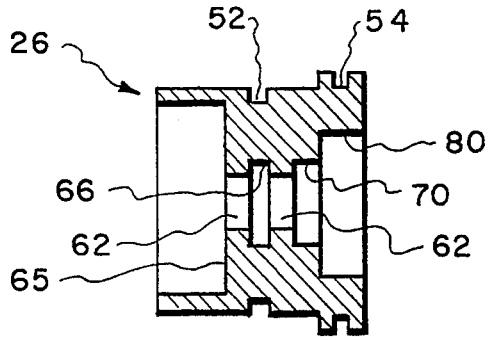
FIG. 7 is a side view in cross-section of insert 26.

FIG. 3 shows a cross section of drillhead 12 attached by screws 11 to mount 10, gearbox 8, motor 6, electronics 5 and batteries 4. Casing 170 attaches to the rear portion of drillhead 12.

As shown in FIG. 3, drillhead 12 includes housing 22, driveshaft 2, insert 26, valve 28, baseplate 30, nozzle 32 and seal 166. Driveshaft 24 is rotatably located in housing 22 via caged needle bearing 34 which rides on race 36. Referring to FIGS. 4, 4*a*, 4*b* and 3, squared end 38 slidably engages bore 23 of coupler 21. Thrust bearing 40 is located around race 42 and abuts shoulder 44 on one side and abuts thrust washer 46 on the other side. Shaft 60 of driveshaft 24 extends through and is sealed in bore 62 of insert 26 (See FIG. 7) by o-ring 64 located in groove 66 and by seal 68 located in bore 70. Shoulder 63 of driveshaft 24 is located adjacent shoulder 65 of insert 26. The rearward facing side of thrust washer 46 abuts face 47 of housing 22.

Insert 26 is located in housing 22 and is sealed by 1st o-ring 48 in groove 52 abutting bore 56 (See FIG. 6) of housing 22 and by second o-ring 50 in groove 54 abutting bore 58 of housing 22.

Figure 8:
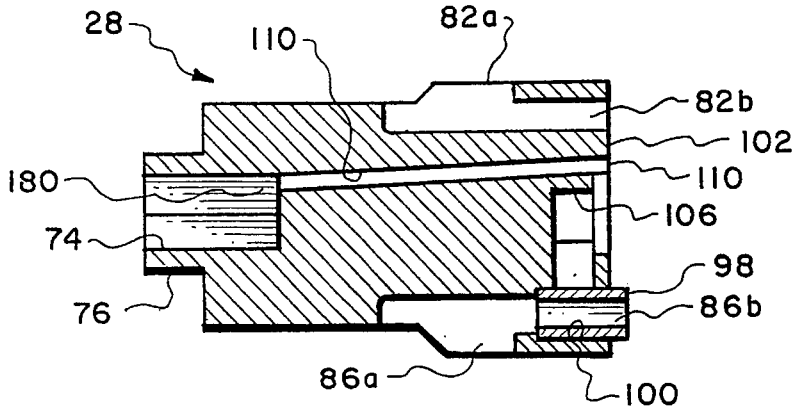
FIG. 8 is a side view in cross-section of valve 28.
Figure 8A:
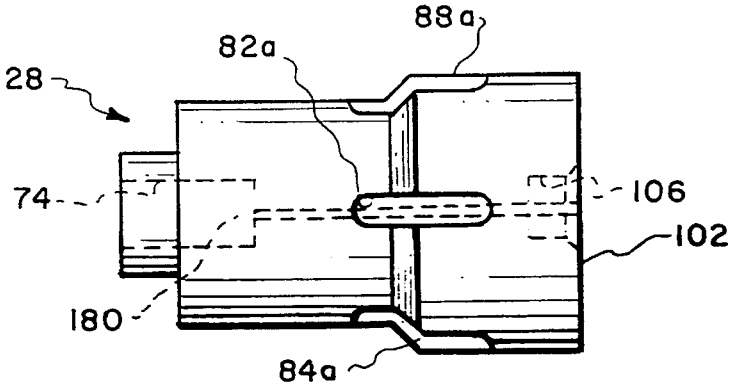
FIG. 8*a* is a top view of valve 28.
Figure 8B:
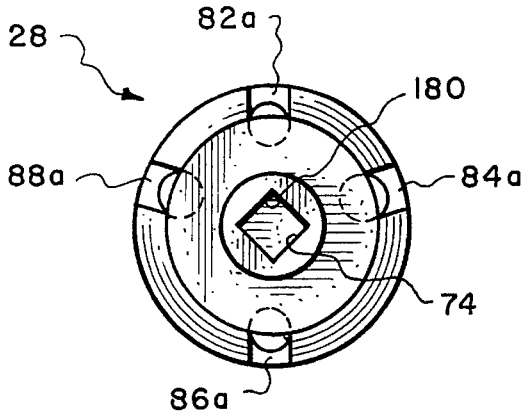
FIG. 8*b* is an end view of valve 28.

Squared end 72 of driveshaft 24 (See FIGS. 4 and 4*b*) communicates with bore 74 in valve 28 (See FIGS. 8, 8*a*, and 8*b*). Shoulder 76 of valve 28 sealably communicates with seal 78 located in bore 80 of insert 26. It can thus be seen that coupler 21, driveshaft 24 and valve 28 rotate as a unit.

Figure 8C:
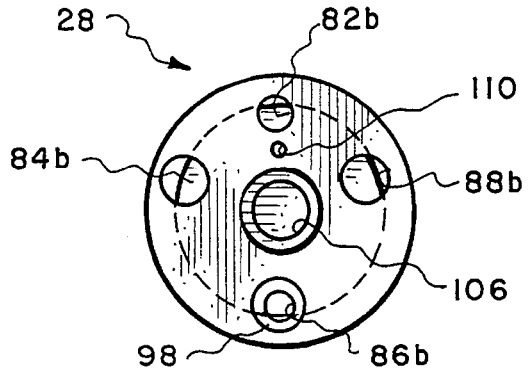
FIG. 8*c* is an end view of valve 28.
Figure 9:
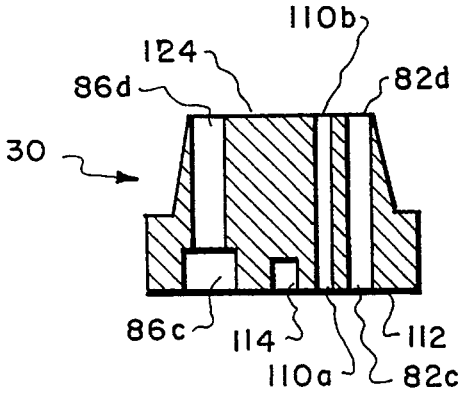
FIG. 9 is a cross-section taken through section 9—9 of FIG. 9*a*.
Figure 9A:
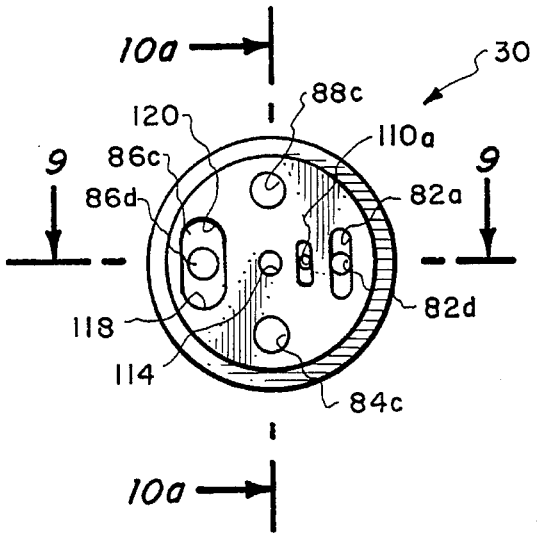
FIG. 9*a* is an end view of baseplate 30.

Referring now to FIGS. 8–8*c*, elongated bores 82*a*, 84*a*, 86*a* and 88*a* are located around the circumference of valve 28. (Note, in FIG. 8*b*, that the bores are not evenly spaced around the circumference of valve 28.) As can be seen from the drawings, elongated bore 82*a* changes shape from an elongated bore at 82*a* (as viewed in FIG. 8*a*) to a circular bore 82*b* (as viewed in FIG. 8*c*). In a similar fashion, elongated bores 84*a*, 86*a* and 88*a* change shape to circular bores 84*b*, 86*b* and 88*b*, respectively. All 4 bores exit valve 28 at face 102. Hollow stop pin 98 is located in bore 100 and extends outwardly from face 102. It should be noted that the forwardly portion of circular bore 86*b* is the inside of hollow stop pin 98.

Caged roller bearing 104 is located in bore 106 and dowel pin 108 (shown in FIG. 3), is rotatably located therein extending outwardly from face 102. Bleed port 110 extends from bore 74 to face 102.

Face 102 of valve 28 abuts face 112 of baseplate 30 and dowel pin 108 engages bore 114. Hollow stop pin 98 is located in elongated bore 86c. It can thus be seen that valve 28 may be rotated relative to baseplate 30, the rotation limited in one direction by hollow stop pin 98 contacting face 118 of elongated bore 86*c* and the rotation limited in the other direction by hollow stop pin 98 contacting face 120 of elongated bore 86*c*. Elongated bore 86*c* changes shape to circular bore 86*d* (see FIG. 9*b* for a typical cross section) and exits baseplate 30 at face 124.

Figure 9B:
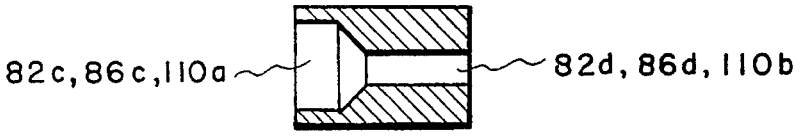
FIG. 9*b* is a cross-section of a typical bore shape change for bore 82*c*, 86*c* or 110*a*.

Bore 82*b* and bleed port 110 communicate with elongated bores 82*c* and 110*a*, respectively. Elongated bore 82*c* changes shape to circular bore 82*d* and elongated bore 110*a* changes shape to circular bore 110*b*. FIG. 9*b* shows a typical cross section of the shape change of bores 82*e*, 86*c* and 110*a*. It can now be appreciated that since the rotation of valve 28 relative to baseplate 30 is limited, bores 82*b*, 86*b* and 110 in valve 28 are, at all times, communicating with their respective bores 82*c*, 86*c* and 110*a* in baseplate 30. However, bore 88*b* communicates with bore 88*c* only when valve 28 is rotated in a first direction (i.e. clockwise) relative to baseplate 30, when viewed from the front as shown in FIG. 3. In a similar fashion, bore 84*b* communicates with bore 84*c* only when valve 28 is rotated in a second direction (i.e. counterclockwise) relative to baseplate 30, when viewed from the front as shown in FIG. 3.

In this way, bores 84*c* and 88*c* may be turned "on" and "off" with one bore always in the "on" or flowing alignment. It should be noted that there is some overlap between these 2 bores when transitioning from flow in one bore or the other which prevents stopping the flow of drilling fluid (ie. water) to these 2 bores altogether. When one bore is "on" the other is "off". Accordingly, shock loads due to inertia effects are significantly reduced.

Figure 10:
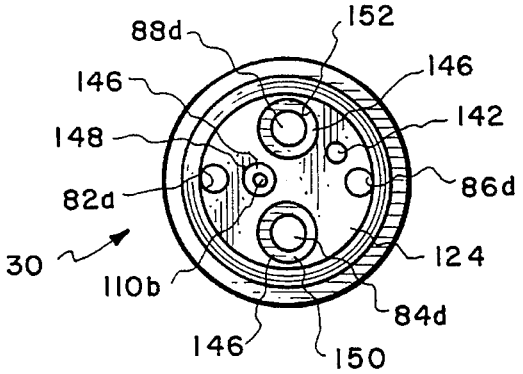
FIG. 10 is an end view of baseplate 30.
Figure 10A:
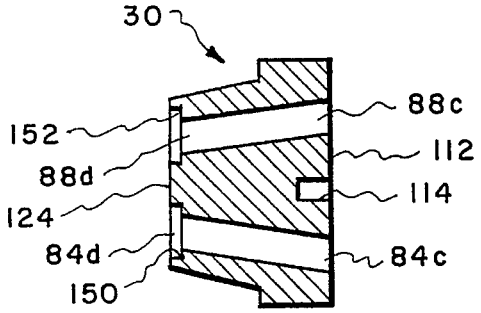
FIG. 10*a* is a cross-section taken through sections 10*a*—10*a* of FIG. 9*a*.
Figure 11:
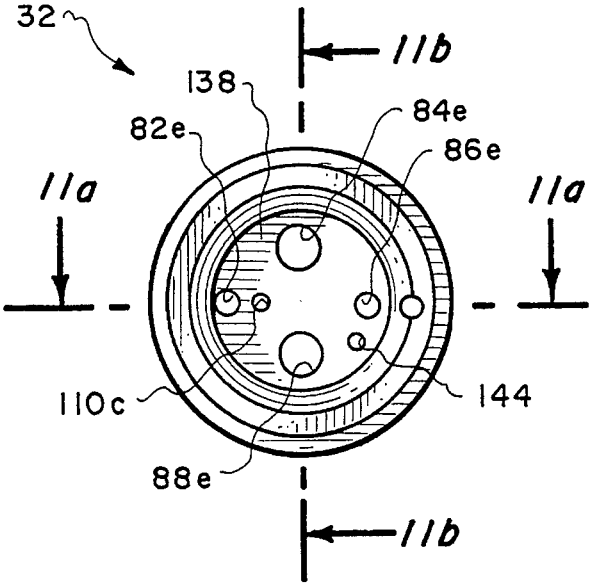
FIG. 11 is an end view of nozzle 32.

Face 124 of baseplate 30 abuts face 138 of nozzle 32 and dowel pin 140 communicates with both bore 142 of baseplate 30 and with bore 144 of nozzle 32, thereby positioning the bores in baseplate 30 with the corresponding bores in nozzle 32. O-rings 146 are located in grooves 148, 150 and 152. As shown in FIGS. 10 and 11, bleed port 110*b* aligns with bore 110*c* in nozzle 32; bore 82*d* aligns with bore 82*e*; bore 86*d* aligns with bore 86*c*; bore 88*d* aligns with bore 88*e*; and bore 84*d* aligns with bore 84*e*. FIG. 11*c* shows the location of the bores as they exit end 165 of nozzle 32. FIG. 12 is a table showing the angles that the centerline of bores 86*e–f*; 82*e–f*; 88*e–f*; and 84*e–f* make with the centerline of nozzel 32. Each configuration requires a different nozzle 32.

Figure 11A:
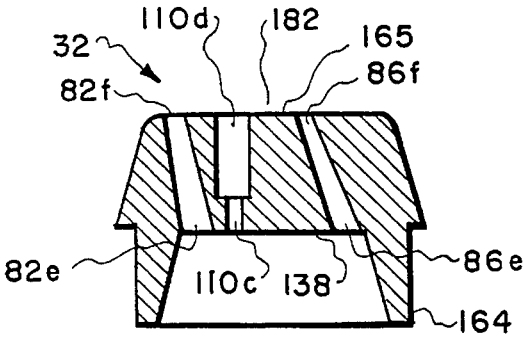
FIG. 11*a* is a cross-section taken through section 11*a*—11*a* of FIG. 11.
Figure 11B:
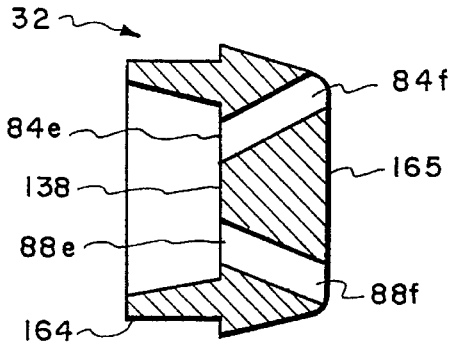
FIG. 11*b* is a cross-section taken through section 11*b*—11*b* of FIG. 11.
Figure 11C:
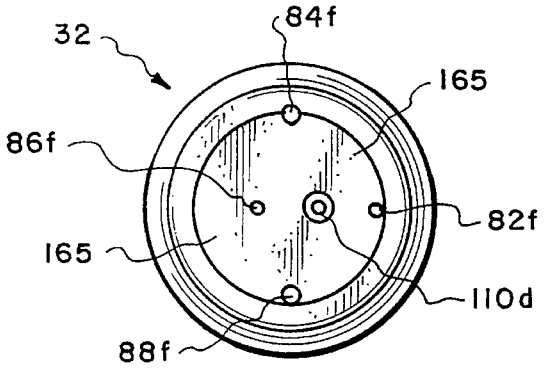
FIG. 11*c* is an end view of nozzle 32.
Figure 11D:
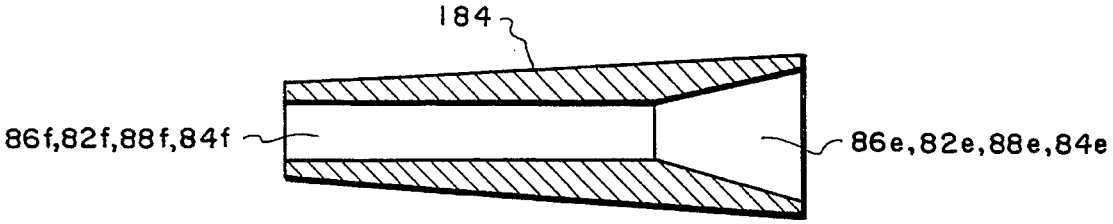
FIG. 11*d* is a cross-section of inserts 184.

Bores 86*e/f* and 82*e/f* in FIG. 12, should be read in conjunction with FIG. 11*a*. Note that the centerline of bore 86*e/f* is directed inwardly towards the centerline of nozzel 32 and is denoted with a minus (–) designation. All other bore centerlines are directed outwardly, away from the centerline of nozzel 32 and are denoted as a positive (+) value. Bores 84*e/f* and 88e/f in FIG. 12, should be read in conjunction with FIG. 11*b*. Configuration 2 (narrow) is preferred for highly consolidated (ie. hard) material such as rock, quartz or granite. Configuration 3 (wide) is preferred for soft materials such as sandstone and shale. Configuration 1 (medium) is preferred for medium consolidation that lies between configuration 2 and 3. Other configurations may be employed for specific applications, as desired. Bores 86*f*, 82*f*, 88*f* and 84*f* may also have different diameters and to facilitate changes in these diameters inserts 184 (see FIG. 11*d*) may be inserted into each bore. The inserts may also be of a hardened material to improve wear resistance. The diameter of the bores are a function of the flow rate, back pressure at nozzel face 165, and the material that is being cut. FIG. 12*a* shows the preferred orifice diameters for various combinations of flow rate and back pressure. Other combinations may be adopted by those skilled in the art for various materials. Note in FIG. 11*d* that bores 86*e*, 82*e*, 88*e* and 84*e* have the following diameters, respectively: 0.216", 0.271", 0.334", and 0.334".

As shown in FIG. 3, nozzle 32 screwably attaches to housing 22 via threads 164. Seal 166 attaches around nozzle 32/housing 22 interface and includes a tapered, forward extending portion 168 which seals with reduced diameter section 15 of drillstring 14 (see FIG. 4) . Casing 170 is attached to housing 22 via threads 172 and is sealed by o-rings 174.

In operation, SDH assembly 2 is inserted into drillstring 14 and pigged to the forward end by pressurized water until seal 166 abuts and seals with reduced diameter section 15 of drillstring 14. In this position, nose 165 is approximately flush with end 17 of drillstring 14. Pressurized water flows through the annular space between drillstring 14 and casing 170 and into four equally spaced square ports 176 located in housing 22 (see FIGS. 3 and 6). Ports 176 are covered by filter screens 178 to prevent the entry of harmful debris. Water then flows into bores 82*a*, 84*a*, 86*a* and 88*a* of valve 28 and forwardly towards baseplate 30. Bores 86*a* to 86*f* are at all times hydraulically communicating and pressurized water will therefore always flow from bore 86*f*, cutting away (ie. drilling) a generally circular area shown as 86*f* in FIG. 13. Similarly, bores 82*a* to 82*f* are at all times communicating and therefore will cut away a generally annular area shown as 82*f* in FIG. 13. Note that drillstring 14 is rotating counterclockwise when viewed from the front, as shown in FIG. 3, so that the preferred right hand threads of the drillstring segments 14 will always be tightening to maintain a fight joint 14*c* (FIG. 1*a*). If it is desired to cut straight ahead, valve 28 is caused to rotate clockwise, (when viewed from the front as shown in FIG. 3) relative to baseplate 30, thereby aligning bore 88*b* with 88*c* at the valve/baseplate interface and permitting the flow of water through bores 88*a* to 88*f* and cutting the generally annular area shown as 88*f* in FIG. 13. Note, that the combined areas cut by bores 86*f*, 82*f* and 88*f* is just slightly larger in diameter than drillstring 14. Pushed drillstring 14 will then advance straight ahead into this cut area. When cutting straight ahead, bore 84*f* will remain off.

Figure 2:
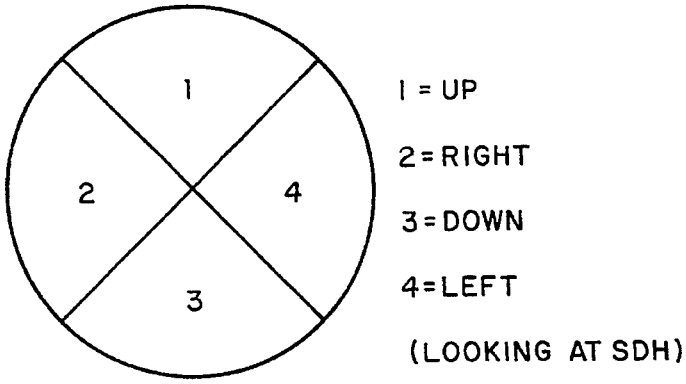
FIG. 2 is representation showing the orientation of the four drilling quadrants, in the preferred embodiment, that SDH assembly 2 may be deviated.
Figure 13:
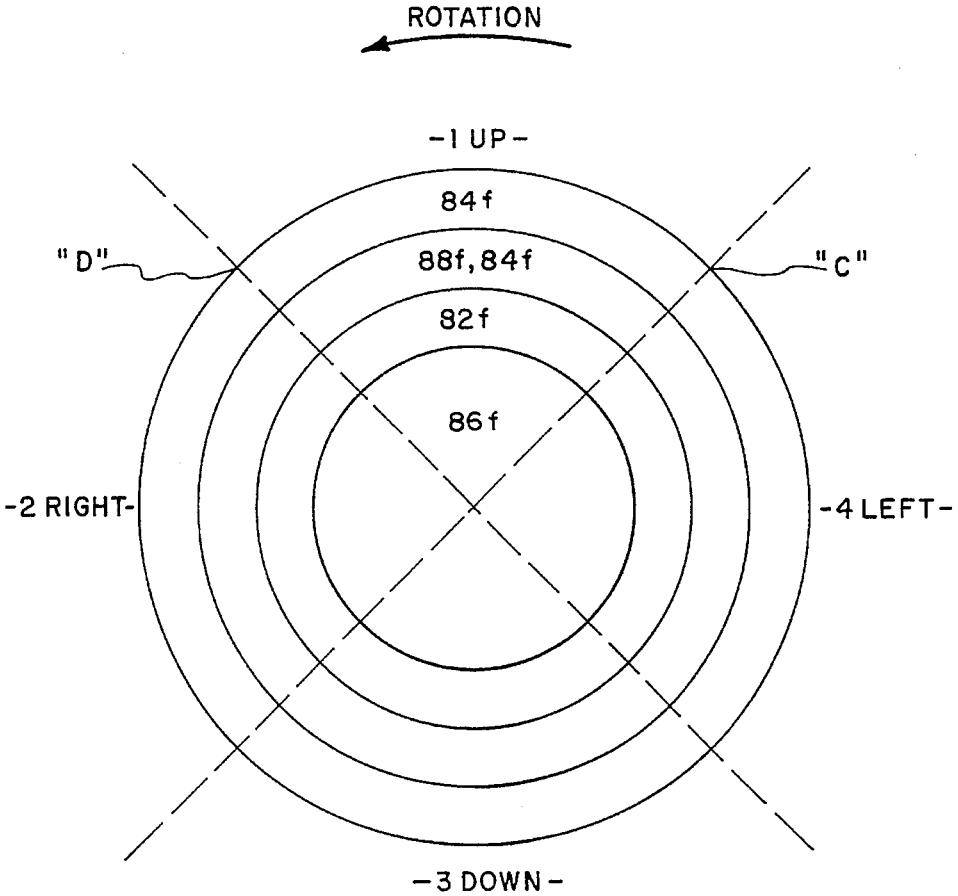
FIG. 13 is a diagram showing the cross-sectional area cut by each of the four cutting bores and the four quadrants (directions) that SDH 2 may be deviated.

When it is desired to deviate drillstring 14 away from cutting in the straight ahead mode, drillhead 12 may be operated, in the prefered embodiment, to deviate in the direction of any one of the quadrants (ie. 1,2,3 or 4) shown in FIGS. 2 and 13. (Note that FIGS. 2 and 13 are views looking at the front of SDH 2 and therefore quadrant 2 is to the right and quadrant 4 is to the left).

Figure 14:
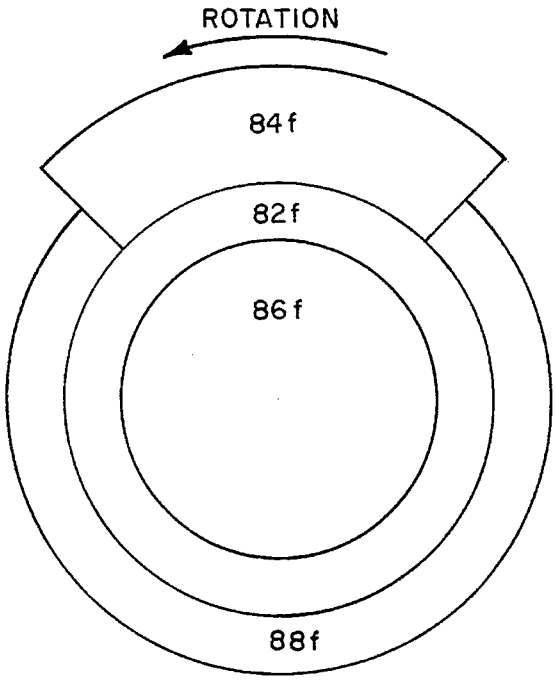
FIG. 14 is a diagram of a theoretical deviated bore, in cross-section, when operating SDH 2 to deviate upwardly (ie. into quadrant 1).

To deviate, for example, upwardly (towards quadrant 1), bore 84*f* is turned "on" between points "C" and "D" during each rotation of drillstring 14 and turned "off" between points "D" and "C" during each rotation of drillstring 14 thus cutting the area designated 84*f* in FIG. 14. Since bores 84*f* and 88*f* operate in an opposite fashion, bore 84*f* is "off" when bore 88*f* is "on" and vice versa. Bore 88*f* will be "on" between points "D" and "C" cutting the area designated as 88*f* in FIG. 14. Bores 86*f* and 82*f* are always "on" and cut the area designated as 86*f* and 82*f*, respectively, as shown in FIG. 14. Note that the radially inward portion of area 84*f* overlaps area 88*f*. Also note, that in practice, bores 84*f* and 88*f* are not turned "on" and "off" instantaneously so that the actual area cut will approximate the area shown in FIG. 14. As material is cut, pushed drillstring 14 will follow the deviated path towards area 84*f* in quadrant 1 (FIG. 14) and turn from a straight ahead path to an upwardly path.

It can now be appreciated, that drillstring 14 may be steered in any direction by simply rotating valve 28 in one direction or the other at the appropriate time during each rotation of drillstring 14. A non-concentric, oblong path may be cut in any desired direction. The preferred embodiment uses 4 quadrants for deviation.

In the preferred embodiment, SDH 2 may operate in conjunction with logging tool 19 which provides real time location information including azimuth and depth. Drillstring length is determined by pigging logging tool 19, with attached cable, down to SDH 2 and recording the length of cable used. When it is desired to determine the locatin of SDH 2, drilling is suspended and drillstring 14 continues to rotate. Logging tool 19 is then pigged to SDH 2 and the location information is sent back via the attached cable to information center 13 and analyzed to determine position. SDH 2 is then instructed to drill straight ahead or in one of the 4 available quadrants.

SDH assembly 2 operates with pressurized water of up to 15,000 psi and above, and therefore considerable forces are present in drillhead 12 which affects the force required to rotate driveshaft 24/valve 28. Since SDH assembly 2 is a self continued, battery powered, limited size device with limited power and operational time,, it is necessary to maximize operating characteristics to increase operating time. Accordingly, gearbox 8 increases the torque output of motor 6 to driveshaft 24. Thrust bearing 40 is fitted and reduces the force required to rotate driveshaft 24/valve 28. In addition, bleedport 110 to 110*d* "balances" valve 28 so that the sum of the forces tending to move valve 28 forwardly approximately equals the forces tending to move valve 28 rearwardly. Thus, bleedport 110 communicates with high pressure area 180 in bore 74 of valve 8 (see FIGS. 8 and 8*a*) and with lower pressure area 182 at nose 165 of nozzle 32 (see FIGS. 3 and 11*a*).

Obviously, many modifications and varations of the present invention are possible in light of the above teachings. It is therefore to be understood that within the scope of the appended claims, the invention may be practiced otherwise than as specifically described.

I claim:

1. An apparatus for boring a continuous underground tunnel, the apparatus located in the forward end of a continuously rotating, pushed drillstring, comprising:

a) a housing for receiving pressurized drilling fluid;

b) a nozzle attached forwardly to the housing, the nozzle having 1st, 2nd, 3rd and 4th bores for discharging the pressurized drilling fluid;

c) a valve located in said housing, the valve having 1st, 2nd, 3rd and 4th bores for receiving and forwardly directing said pressurized drilling fluid simultaneously to at least two bores in said nozzle, the valve rotatable to a first position to allow said pressurized drilling fluid to be discharged from said nozzle to bore a tunnel straight ahead or said valve rotatable to a first position during part of each revolution of said drillstring and rotatable to a second position during the remaining part of each revolution of said drillstring to allow said pressurized drilling fluid to be discharged from said nozzle to bore an off-axis tunnel, the 1st, 2nd and 3rd bores in said valve and in said nozzle communicate when said valve is in the first position and said 1st, 2nd and 4th bores in said valve and in said nozzle communicate when said valve is in the second position, d) means for sealing said nozzle in said drillstring.

2. The apparatus defined in claim 1, further including means for rotating said valve.

3. The apparatus defined in claim 2, wherein the means for rotating said valve is a driveshaft located in said housing and rearwardly extending therefrom, the driveshaft communicating with said valve in said housing.

4. The apparatus defined in claim 3, further including a bleed port extending from a high pressure area rearwardly of said valve to a low pressure area forwardly of said nozzle for balancing the forward and rearward forces acting on said valve.

5. The apparatus defined in claim 4, further including an insert located in said housing for supporting and sealing said driveshaft, the insert also communicating with and supporting said valve.

6. The apparatus defined in claim 5, further including a baseplate located in said housing and between said valve and said nozzle, the baseplate including bores that communicate on one end with said bores in said nozzle and communicate on the other end with said bores in said valve, said baseplate rotatably attached to said valve.

7. The apparatus defined in claim 6, further including ports in said housing for receiving said pressurized drilling fluid.

* * * * *

UNITED STATES PATENT AND TRADEMARK OFFICE

CERTIFICATE OF CORRECTION

PATENT NO. : 5,513,713

DATED : May 7, 1996

INVENTOR(S) : Frank K. Groves

It is certified that error appears in the above-indentified patent and that said Letters Patent is hereby corrected as shown below:

On the Title Page, "Attorney, Agent, or Firm-David S. Kalmbaugh; Melvin J. Sliwka" should read --Attorney, Agent, or Firm-David S. Kalmbaugh; Melvin J. Sliwka; Ron G. Billi--

Signed and Sealed this

Eleventh Day of March, 1997

*Attest:*

BRUCE LEHMAN

*Attesting Officer*

*Commissioner of Patents and Trademarks*